US005427619A

United States Patent [19]

Ehinger et al.

[11] Patent Number: 5,427,619

[45] Date of Patent: Jun. 27, 1995

[54] COATING PRODUCT SPRAYER DEVICE FORMING AN OVERHEAD OR LATERAL MACHINE

[75] Inventors: Pierre Ehinger, Faverges; Gilles Lambinet, Meylan, both of France

[73] Assignee: Sames S.A., Meylan, France

[21] Appl. No.: 143,752

[22] Filed: Nov. 1, 1993

[30] Foreign Application Priority Data

Oct. 6, 1993 [FR] France ..... 93 11901

[51] Int. Cl.[6] ..... B05B 3/00

[52] U.S. Cl. ..... 118/323; 118/315; 118/324; 118/326

[58] Field of Search ..... 118/309, 313, 315, 323, 118/324, 326, DIG. 7

[56] References Cited

U.S. PATENT DOCUMENTS

| | | | |
|---|---|---|---|
| 3,391,494 | 7/1968 | Dye, Jr. | 118/323 X |
| 3,606,162 | 9/1971 | Lehmann | 239/227 |
| 4,323,030 | 4/1982 | Lehmann, Jr. | 118/326 X |
| 4,417,541 | 11/1983 | Schäfer | 118/326 |
| 4,548,967 | 10/1985 | Brown et al. | 524/56 |
| 4,977,000 | 12/1990 | Murayama et al. | 118/326 X |
| 5,266,115 | 11/1993 | Taccon et al. | 118/323 X |

FOREIGN PATENT DOCUMENTS

| | | |
|---|---|---|
| 2641688 | 6/1989 | Australia . |
| 0320378 | 6/1989 | European Pat. Off. . |
| 2131164 | 11/1972 | France . |
| 2599642 | 12/1987 | France . |
| 1446755 | 11/1968 | Germany . |
| 1805145 | 9/1970 | Germany . |
| 3641660 | 6/1987 | Germany . |
| 1111750 | 5/1968 | United Kingdom . |
| 1334747 | 10/1973 | United Kingdom . |

*Primary Examiner*—Mark A. Osele
*Attorney, Agent, or Firm*—Spensley Horn Jubas & Lubitz

[57] ABSTRACT

In a coating product sprayer device forming an overhead machine comprising a boom carrying at least one sprayer mobile relative to objects to be sprayed the boom is moved up and down and to track the objects laterally by flexible strips which form part of the wall of the booth. The invention can also be applied to a lateral machine, yielding a lateral machine with five degrees of freedom.

9 Claims, 3 Drawing Sheets

COATING PRODUCT SPRAYER DEVICE FORMING AN OVERHEAD OR LATERAL MACHINE

BACKGROUND OF THE INVENTION

1. Field of the invention

The invention concerns a device for spraying coating product in liquid or powder form forming an overhead or lateral machine. It is more particularly concerned with a drive system for the boom or the arm of a sprayer in a machine of this kind for upward and downward movement and for tracking lateral movement of the object to be coated.

2. Description of the prior art

In prior art overhead machines a boom is fastened to two box-sections by means of bearings allowing rotation of the boom about its major axis. The vertically mobile box-sections simply rest on gantries. This relatively complex structure requires very accurate dimensioning of the articulations of the boom/box-section/-gantry assembly if flexing of the structure is to be avoided. The box-sections contain some drive components and extend the full length of lateral tracking of objects to be painted by the boom. They are heavy and bulky and seriously disrupt the ventilation of the coating booth and therefore the quality of application. The dimensions of the box-sections depend on the travel of the boom, i.e. on parameters inherent to the object to be painted and/or to the system conveying these objects.

The box-sections tend to become soiled as they are exposed to a disturbed atmosphere loaded with particles of paint.

Access from inside the booth to any drive or coating product supply components of the boom and the sprayers that it carries is difficult and is possible only when the installation is stopped and then in areas where access is difficult.

Prior art lateral machines do not usually allow tracking of the objects to be coated. Those which do allow it are made up of complex components which must be accommodated inside the booth and accordingly disrupt the ventilation of the booth.

The invention solves all these problems.

SUMMARY OF THE INVENTION

In one aspect, the invention consists in a coating product sprayer device comprising a member carrying at least one sprayer mobile relative to objects to be coated moved up and down and to track said objects laterally by means of flexible strips.

In another aspect, the invention consists in a coating product sprayer device constituting a lateral machine comprising at least one sprayer carried by an arm mobile relative to objects to be coated and having five degrees of freedom.

By virtue of the invention the machines hardly disturb the flow of air in the coating booth which makes it possible to obtain a satisfactory surface finish on the plane surfaces of the objects, such as the roof, the hood or a door of an automobile vehicle body. The invention also makes it possible to obtain access to the drive and coating product supply components from outside the booth, which is both faster and easier.

In the case of an overhead machine (or roof machine) the invention also improves the kinematics of the machine. It is possible to avoid flexing of the boom as the latter can pass through the wall of the booth and be supported not at its end but at a point intermediate its ends. At least some of the drive components of the sprayer(s) may be disposed outside the boom, which lightens it commensurately and allows its cross-section to be reduced and its aerodynamics to be improved. It is not necessary to provide small radius of curvature passages at the ends of the boom for the coating product supply pipes as the ends of the boom are outside the booth, where there is more room. Head losses in these pipes are reduced accordingly and the risk of crushing of flexible hoses is minimized.

In the case of a lateral machine the fact that there are five degrees of freedom means that the sprayer travel can be adapted to suit objects of complex shape or to paint objects which are stationary on a conveyor, saving much space and time. The advantages associated with the ventilation of the booth and with accessibility mentioned above with reference to an overhead machine are equally valid in the case of a lateral machine.

By virtue of the invention all of the components affected by the travel of the boom or the sprayers are located outside the booth: it is easy to parameter an installation according to the shape of the object to be painted. Thus the invention enables improved standardization of installations.

The invention is put into effect by two sets of flexible fluid-tight strips one of which slides within the width of the other and carries a carriage on which a boom or a sprayer can move. These strips form part of the coating boom wall and are cleaned by any suitable means such as a scraper or a suction manifold, possibly with the assistance of a bar for depositing an anti-adhesion product.

The invention will be better understood and other advantages of the invention will emerge more clearly from the following description of two embodiments of coating product sprayer devices in accordance with the invention given by way of example only and with reference to the appended drawings.

DETAILED DESCRIPTION OF THE INVENTION

Figure 1:
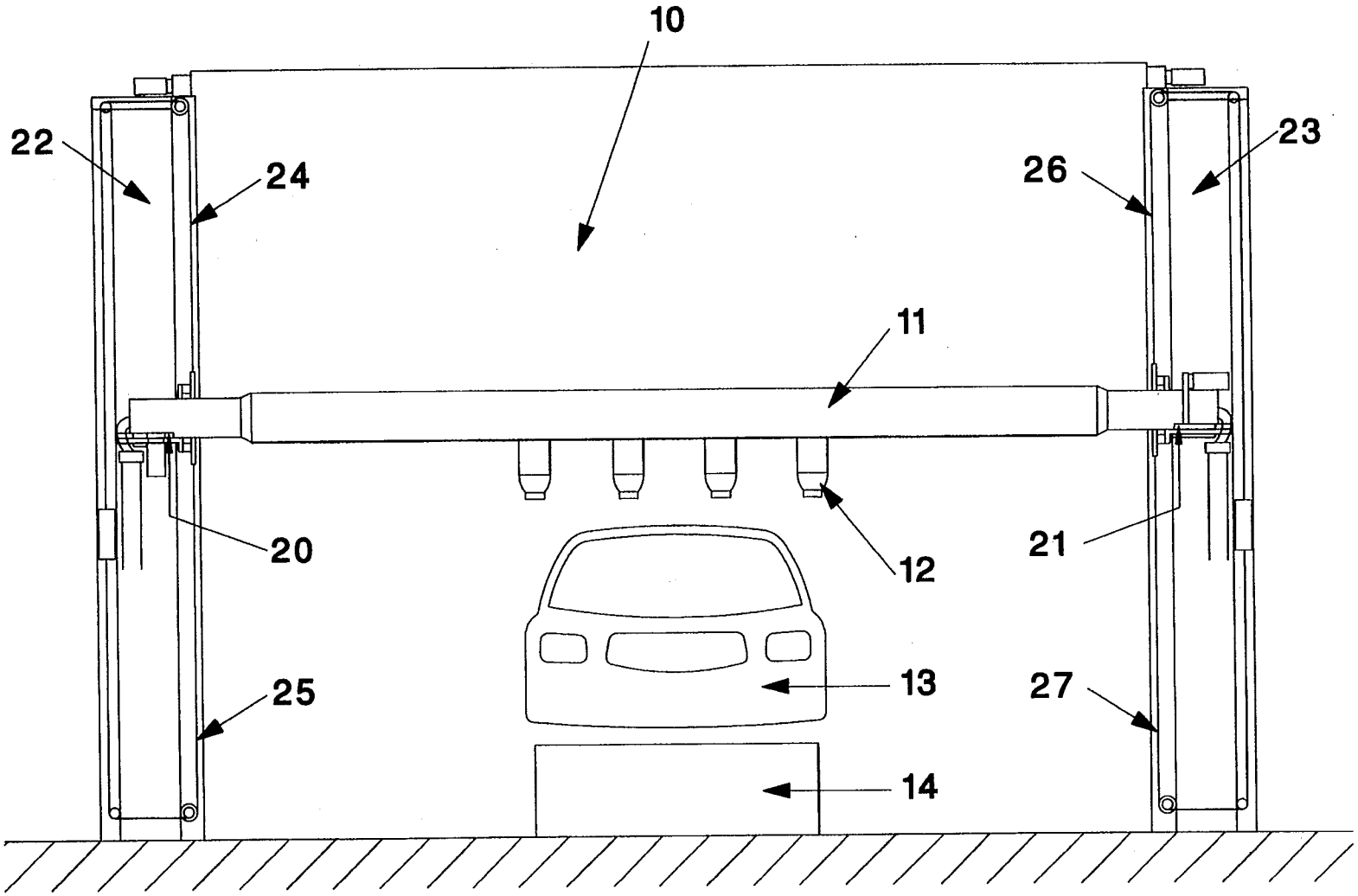
FIG. 1 is a diagrammatic partial cross-section view of an overhead machine in accordance with the invention.

The overhead machine in FIG. 1 operates inside a spray booth 10 and comprises a boom 11 carrying four sprayers 12 for applying a coating product to the front and rear horizontal parts of an object such as an automobile vehicle body 13 carried by a conveyor 14, for example.

The boom 11 is carried by two carriages 20 and 21 which enable rotary and translatory movement of the boom between two gantries 22 and 23. The carriages are supported by flexible primary strips 24, 25, 26 and 27 and are situated on the opposite side of these strips to the interior of the booth. The ends of the boom 11 are therefore on the side of the strips 24 through 27 opposite the interior of the booth 10. The boom may have a relatively small cross-section as it is easy to prevent it flexing despite the weight of the sprayers 12 by loading its ends. This small cross-section minimizes disturbance to the ventilation of the booth 10 near the sprayers 12.

Figure 2:
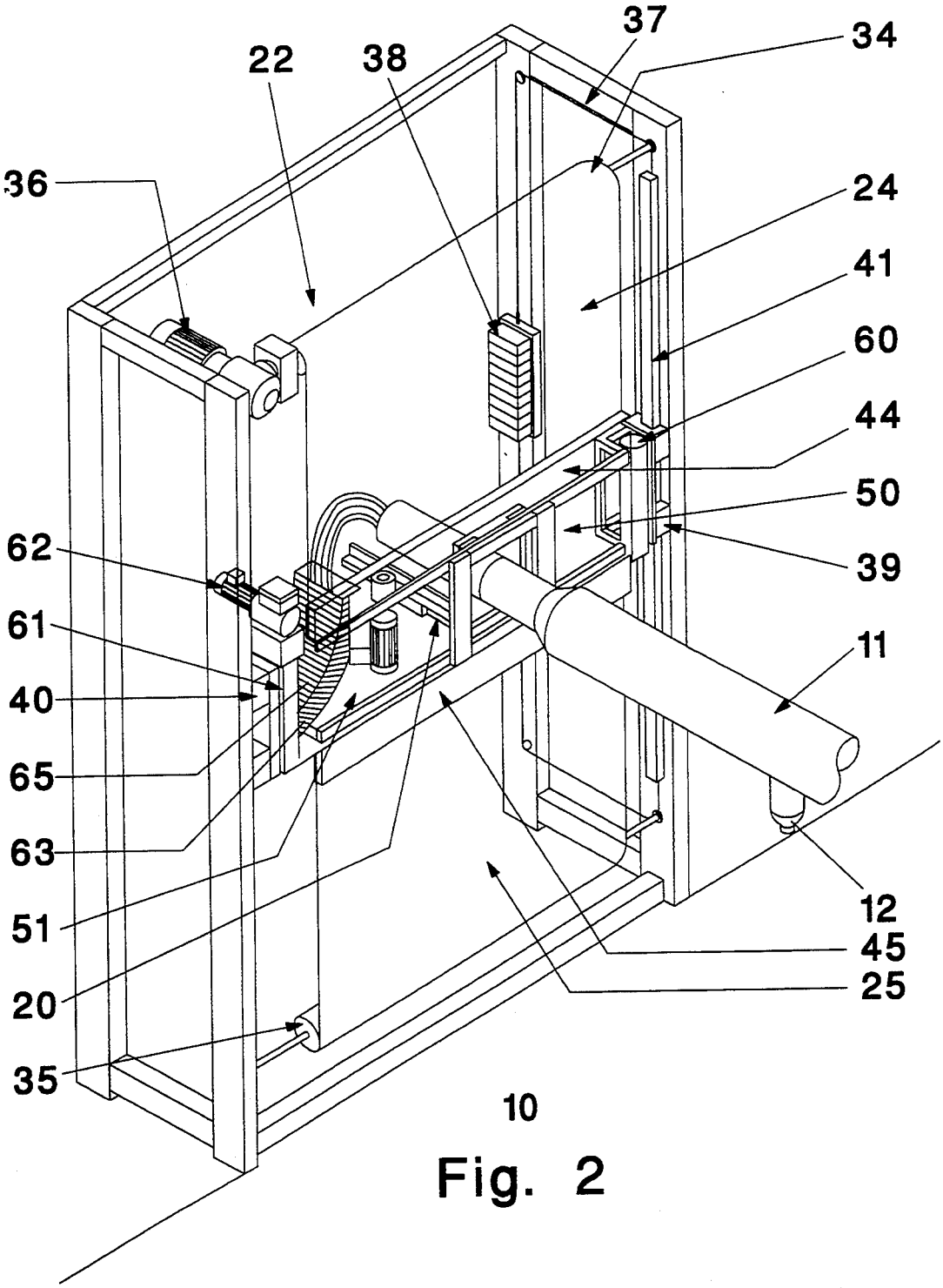
FIG. 2 is a diagrammatic partial perspective view of a gantry of the overhead machine from FIG. 1.

FIG. 2 is a diagrammatic partial view of the gantry 22 and one end of the boom 11 which carries a sprayer 12. The flexible strips 24 and 25 are able to wind and unwind on respective rollers 34 and 35 as the carriage 20 moves upwards and downwards. This movement is driven by an electric motor 36 and a cable 37 and counterweight 38 system which transfers the loads from one strip to the other and guarantees that the combination is correctly tensioned and balanced.

Carriages 39 and 40 moving on rails 41 locate the ends of the strips 24 and 25 as they move vertically. As the strips 24 and 25 are made from a single piece of flexible material that is strong in traction and in shear and as these strips are driven over all the width of the rollers 34 and 35 the carriages 39 and 40 are held at exactly the same height. This avoids any risk of the sets of strips jamming.

Sealing plates that are not shown to avoid overcomplicating the drawing but that will be familiar to the man skilled in the art prevent particles of paint escaping from the booth 10 between the strips 24 and 25 and the rails 41.

The lower part of the upper strip 24 is fastened to a rail 44. Likewise the upper part of the lower strip 25 is fastened to a rail 45. Between the two rails are two flexible secondary strips 50 and 51 able to wind and unwind on respective rollers 60 and 61 as the carriage 20 moves to the left and to the right. The secondary strips 50 and 51 therefore move within the width of the primary strips 24 and 25. These movements are driven by an electric motor 62.

In other words, the strips 24 and 25 displace the secondary strips 50 and 51 and the boom 11 along a vertical axis perpendicular to the axis of horizontal displacement of the boom 11 by the secondary strips 50 and 51.

The set of strips 24, 25, 50 and 51 forms part of the wall of the booth 10.

The ends of the strips 50 and 51 farthest from the rollers 60 and 62 are attached to the carriage 20 and define with the rails 44 and 45 an orifice through which the boom 11 passes. An electric motor 63 drives displacement of the boom 11 parallel to its major axis in order to scan it with the sprayers 12. A motor (not shown) attached to the carriage 20 rotates the boom about its major axis and positions the sprayers 12 normal to the surface to be painted of the object 13.

A spooling unit 65 only part of which is shown houses paint pipes, of which there may be 48 for 24 different colors of the coating product, air pipes, solvent pipes and high-tension or low-tension electrical cables in the case of electrostatic sprayers. The space to the rear of the flexible strips, that is to say outside the booth 10, is not subject to any restriction: it is easy to obtain access to the spooling unit 65 and it is not necessary to accommodate it in excessively small spaces, which avoids excessively small radii of curvature for the fluid pipes.

Figure 3:
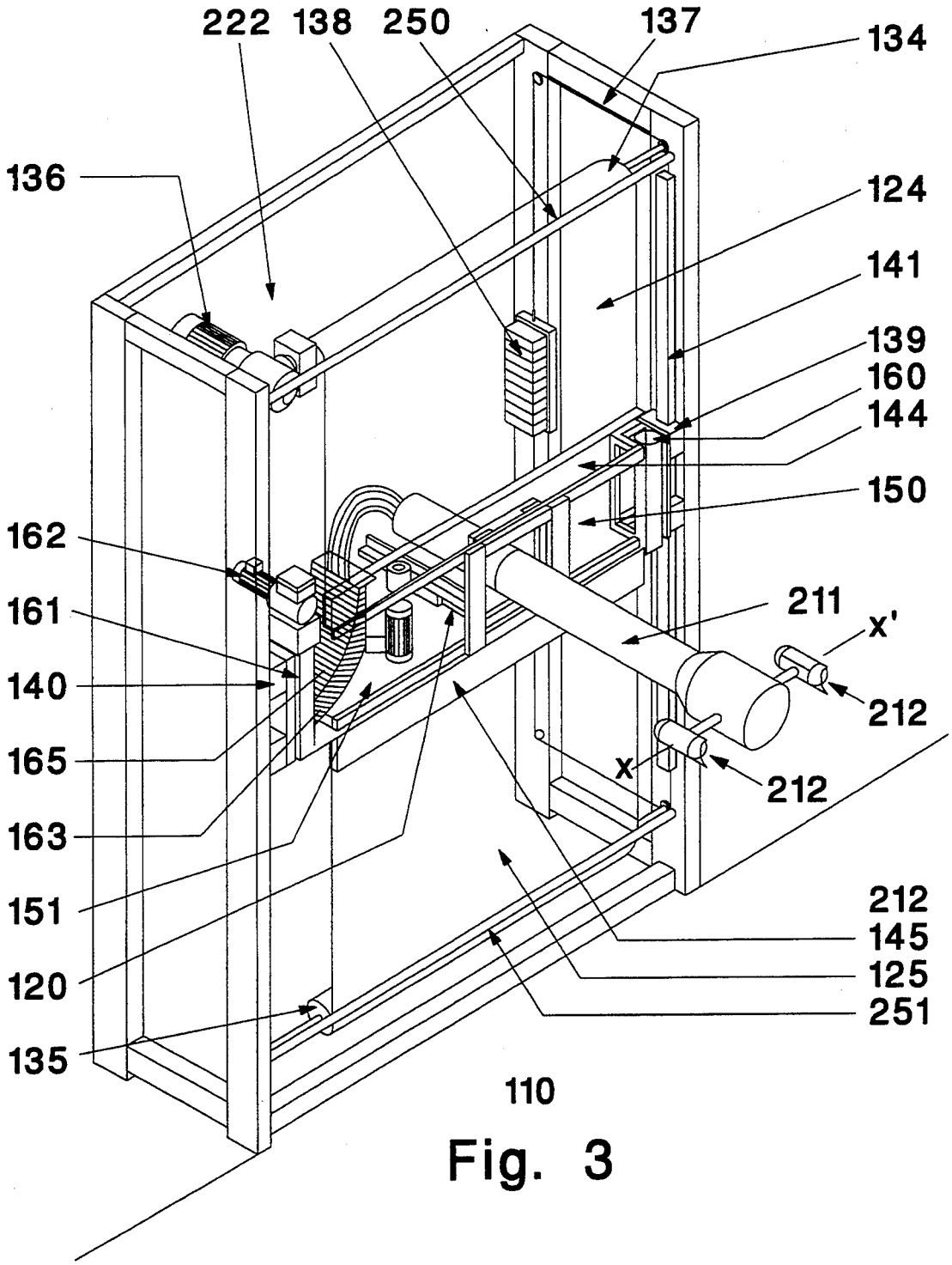
FIG. 3 is a diagrammatic partial perspective view of a lateral machine in accordance with the invention.

The gantry 222 of the lateral machine in FIG. 3 is also constructed in accordance with the invention. Components identical to those of the overhead machine from FIG. 2 carry the same reference numbers increased by 100. An arm 211 carrying two pneumatic sprayers 212, electrostatic sprayers, for example, is rotatable about its major axis by a drive system that is not shown and driven vertically and with a tracking movement by sets of primary strips 124 and 125 and secondary strips 150 and 151. It is also mobile in and out by virtue of movement of the carriage 120 driven by the motor 163. The sprayers may be mobile about the axis XX'. The lateral machine therefore has five degrees of freedom, although it is of simple construction and its manufacturing cost is therefore relatively low.

Cleaning means 250 and 251 are provided to prevent soiling of the primary strips 124 and 125 and the secondary strips 150 and 151. In the case of a painting installation these may be bars for depositing anti-adhesion product and/or scrapers which rub at all times on the strips 124 and 125 so that the strips may be cleaned even during spraying. In the case of a powder-coating installation they may be suction manifolds in contact with the strips which remove any particles of powder deposited on them. Once again they may operate during spraying without disturbing the movements of the sprayers. In both cases movement of the strips by the maximum amount may be caused to enable the cleaning means 250 and 251 to clean all of the surface of the strips 124 and 125. Similar means may naturally be provided on the carriages 139 and 140 for cleaning the strips 150 and 151.

Identical cleaning means can be used on the overhead machine shown in FIGS. 1 and 2.

To enable visual inspection of spraying by an operator the materials of the strips 24 through 27, 50, 51, 124, 125, 150 and 151 may be transparent: as the strips constitute the wall of the coating booth, the operator can see into the booth without needing to enter it. It is sufficient if just one of the strips is transparent, for example a secondary strip 50, 51, 150 or 151.

It is beneficial to choose for the material of the flexible strips a fluid-tight material resistant to the solvents used in painting installations.

In both machines shown in FIGS. 2 and 3 the primary strips provide vertical movement and the secondary strips provide tracking movement. The converse arrangement is equally possible without departing from the scope of the invention. It is sufficient to accommodate the motors 36, 62, 63, 136, 162 and 163 and the rails 41 and 141 appropriately. These modifications will be obvious to the man skilled in the art.

It is also feasible to use a single strip in place of the strips 24 and 25. It is sufficient to cause the single strip to follow the path of the cable 37 and to have it carry the counterweight 38. Access to the drive components is slightly more difficult but still satisfactory. A similar modification can be applied to the strips 50 and 51, the strips 124 and 125 and the strips 150 and 151.

There is claimed:

1. A coating product sprayer device comprising:

a member carrying at least one sprayer mobile relative to objects to be coated;

at least one gantry;

a first set of rollers carried by said gantry;

a carriage movable relative to said gantry and supporting said member;

first strip means cooperating with said first set of rollers and attached to said carriage to move said carriage up and down, wherein said carriage is located between two spaced apart parallel edges of said first strip means;

a second set of rollers mounted for up and down movement with said carriage; and second strip means cooperating with said second set of rollers and attached to said carriage to move said carriage laterally.

2. A device according to claim 1, wherein said first set of rollers comprises two horizontal rollers and wherein said first strip means comprises flexible strips which engage said two horizontal rollers.

3. A device according to claim 1, wherein said first strip means moves both said second strip means and said carriage in a direction perpendicular to a direction of displacement of said carriage by said second strip means.

4. A device according to claim 1, wherein said second strip means operates within the spaced apart parallel edges of said first strip means.

5. A device according to claim 3, wherein said member has a major axis and is rotatable about said major axis and movable in translation along said major axis by said second strip means.

6. A device according to claim 1, wherein said first strip means and said second strip means form a wall of a coating booth.

7. A device according to claim 1, further comprising strip cleaning means disposed in contact with said first strip means.

8. A device according to claim 7, wherein said strip cleaning means are adapted to operate during spraying.

9. A device according to claim 1, wherein said first strip means is made from a transparent material.

* * * * *